US006422624B1

(12) United States Patent
Kauffman et al.

(10) Patent No.: US 6,422,624 B1
(45) Date of Patent: Jul. 23, 2002

(54) WIRE ROPE ROUNDSLING WITH INSPECTION WINDOW

(75) Inventors: Jeffrey A. Kauffman, Lancaster; Mark A. Herman, Landisville, both of PA (US)

(73) Assignee: Lift-All Company, Inc., Landisville, PA (US)

( * ) Notice: Subject to any disclaimer, the term of this patent is extended or adjusted under 35 U.S.C. 154(b) by 0 days.

(21) Appl. No.: 09/813,334

(22) Filed: Mar. 20, 2001

(51) Int. Cl.[7] ..... B66C 1/18
(52) U.S. Cl. ..... 294/74
(58) Field of Search ..... 294/74; 57/3, 21, 57/201, 210

(56) References Cited

U.S. PATENT DOCUMENTS

| | | | | | |
|---|---|---|---|---|---|
| 4,350,380 A | * | 9/1982 | Williams | 294/74 |
| 4,427,940 A | | 1/1984 | Hirama et al. | 324/240 |
| 4,850,629 A | * | 7/1989 | St. Germain | 294/74 |
| 5,238,279 A | * | 8/1993 | Anteau | 294/74 |
| 5,321,356 A | | 6/1994 | Weischedel | 324/262 |
| 5,414,353 A | | 5/1995 | Weischedel | 324/232 |
| 5,651,572 A | * | 7/1997 | St. Germain | 294/74 |
| 6,073,728 A | | 6/2000 | Olsen et al. | 187/414 |

FOREIGN PATENT DOCUMENTS

| | | | | |
|---|---|---|---|---|
| DE | 3130469 | * | 2/1983 | 294/74 |
| DE | 3904325 | * | 6/1990 | 294/74 |
| EP | 281287 | * | 9/1988 | 294/74 |
| JP | 232392 | * | 11/1985 | 294/74 |
| JP | 4341490 | * | 11/1992 | 294/74 |

* cited by examiner

*Primary Examiner*—Johnny D. Cherry
(74) *Attorney, Agent, or Firm*—Martin Fruitman

(57) ABSTRACT

The apparatus is a wire rope roundsling loop with an inspection window. The tubular cover on wire rope roundslings normally prevents visual inspection of the core to find damage or corrosion on the wire rope. The invention provides an open window in the cover over the core which can easily be worked around the roundsling to inspect the entire loop. An added feature is a window cover which is sewn on the cover in the region of the window and can be fastened closed to protect the wire rope and the window.

6 Claims, 2 Drawing Sheets

WIRE ROPE ROUNDSLING WITH INSPECTION WINDOW

BACKGROUND OF THE INVENTION

This invention deals generally with hoisting slings, and more specifically with a wire rope roundsling with a cover and a window in the cover to facilitate inspection of the wire rope core.

Loop type wire rope roundslings are commonly used to hang items from support structures. One typical use for such slings is to hang trusses which hold lights and special effect devices from girders above a stage. Essentially, roundslings are continuous wire rope loops forming a load bearing core which is enclosed within a cover. Typically, these covers, which are intended to afford protection against the environment and abrasion, are constructed of synthetic fabric and form a complete enclosure around the wire rope core. However, such fabric covers also present a problem.

A major safety requirement for the use of wire rope hoisting devices is that they be inspected before each use, but opaque fabric covers prevent simple visual inspection. The only method presently being used to inspect such roundslings is by touch. That is, the inspector feels the wire rope through the cover attempting to determine if a broken strand can be felt. Such an inspection technique requires highly trained inspectors, and even then it does not have a high confidence level. In addition inspection for corrosion of the wires can not be currently done. It would be very beneficial to have a device which permitted visual inspection of round slings and could therefore provide a high degree of confidence in the results of the inspection.

SUMMARY OF THE INVENTION

The present invention provides a simple solution to the problem. A portion of the cover is cut away to provide a window to view the wire rope core. For the present invention, the window is formed near the junction of the ends of the tubular cover by cutting off about a one inch length of part of the circumference of the finished tube. Thus, when the balance of the end of the fabric is attached to the other end of the tube cover, part of the cover is missing and the wire rope core is visible through the location of the missing section of cover. The ends of the tubular cover are joined by heavy stitching in the region of the junction.

To protect the core in the region of the window, a window cover is added there. The window cover typically is a piece of reinforced plastic fabric overlapping and approximately centered on the window, but sewn onto the portion of the cover which remains after the window area is removed. The window cover is large enough to wrap around both the wire rope core and the fabric cover of the round sling at the location of the window, and to have its own ends meet and be attached to each other. In the preferred embodiment the ends of the window cover are attached to each other by the use of Velcro fastening tape.

The method of using the inspection window is not sophisticated, but it works very well. Since the cover covers the wire rope core relatively loosely and is not attached to the core in any way, the fabric cover and the window can be worked around the wire rope core by repeatedly compressing the length of the cover between two hands and then holding one hand tightly on the core and stretching the cover. The motion is essentially the same as when pushing any fabric tube over a long object, except in this case the long object is actually a closed loop. All that is required for the safety inspection is that the wire rope core be viewed as the window passes along it.

The present invention thereby provides a simple and economical means for inspecting the core of a covered roundsling.

DETAILED DESCRIPTION OF THE INVENTION

Figure 1:
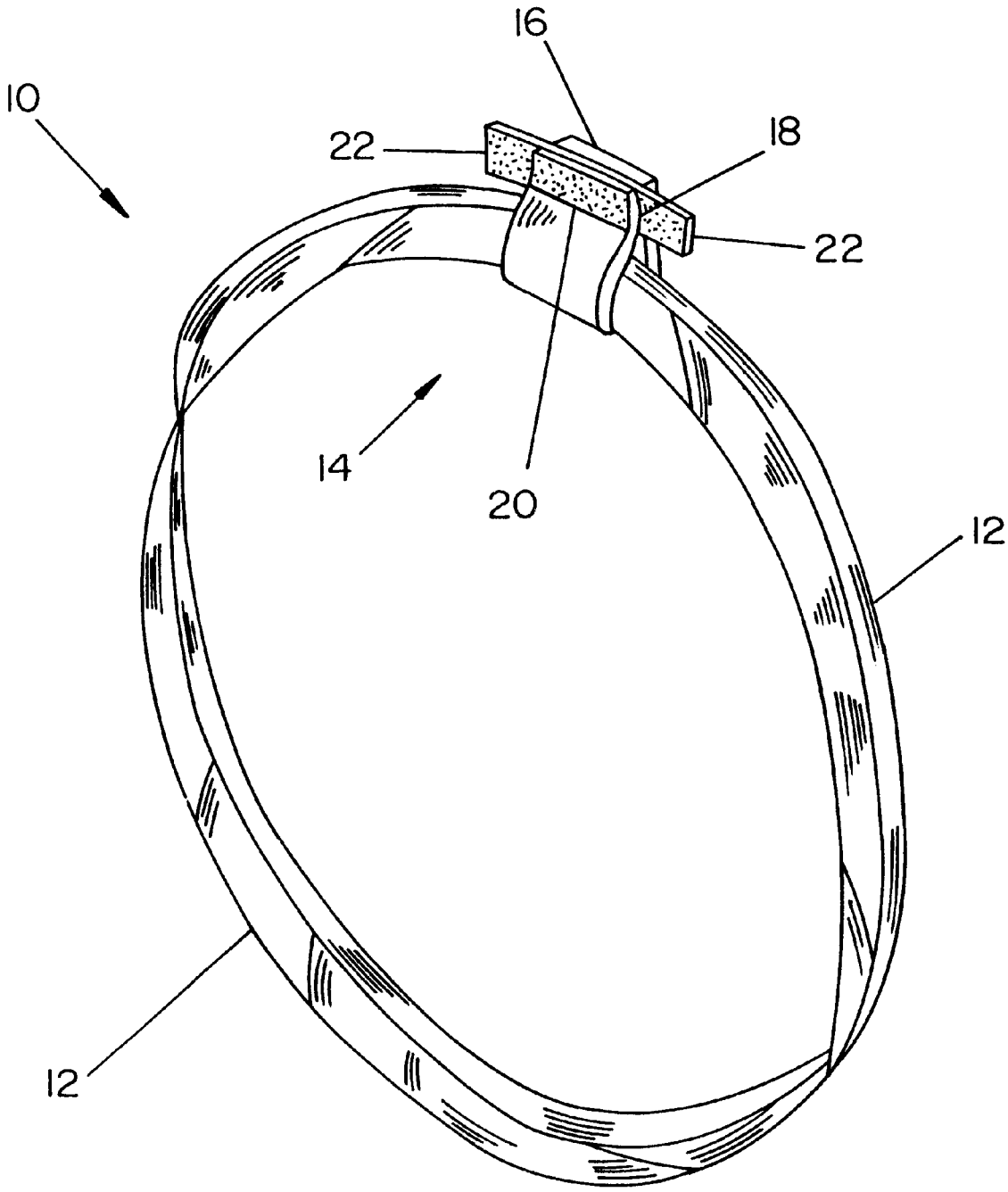
FIG. 1 is a perspective view of the complete roundsling of the preferred embodiment of the invention.

FIG. 1 is a perspective view of complete roundsling 10 shown with flexible cover 12 over the entire roundsling, and window cover 14 shown in the closed position. Window cover 14 has two flaps 16 and 18 with complimentary Velcro fastening tape attached to the different flaps. Thus, the outside of flap 18 has a strip 20 of one type of Velcro tape while flap 16 has attached to it Velcro tape which will attach to the Velcro tape on flap 18. Locking tabs 22 which are attached to flap 16 can then be folded over onto Velcro 20 of flap 18 to lock flap 16 and flap 18 together.

Figure 2:
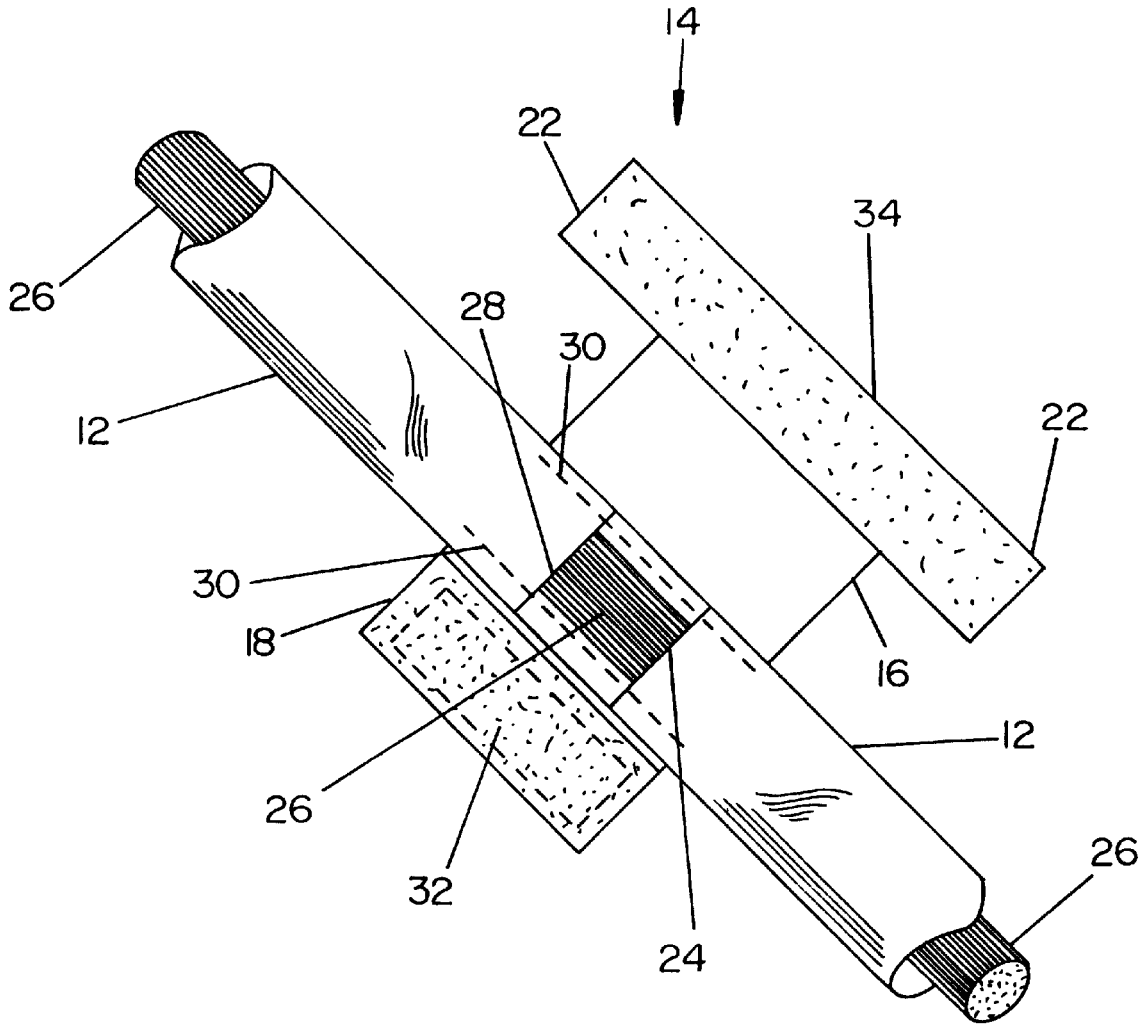
FIG. 2 is a perspective view of the region of a roundsling which includes an inspection window.

FIG. 2 is a perspective view of the region of roundsling 10 around inspection window 24 through which multistrand core 26 can be viewed. Inspection window 24 is constructed as cover 12 is being formed. In the preferred embodiment, cover 12 is made from a length of tubular synthetic fabric. To form the closed loop for roundsling 10 (FIG. 1), the ends of the fabric tube are sewn together using stitching 30 at a location such as junction 28. However, to form inspection window 24 the two ends of the fabric tube are not completely sewn together. Instead, about one half of the circumference of the cross section of tube 12 is cut away from one end of the fabric tube for a short distance. In the preferred embodiment this distance is about one inch. Thus, when the two ends of the fabric tube are sewn together, the absence of part of the circumference of one end forms inspection window 24. One precaution which is required in providing stitching 30 is that fabric cover 12 must remain loose enough around multistrand core 26 to permit core 26 to slide freely through window 24.

The inspection of core 26 is based upon the ability to slide fabric cover 12 over core 26. The method of inspection is to grasp cover 12 in two hands on opposite sides of inspection window 24 with one hand holding only cover 12 and the other hand forcing cover 12 tightly against core 26. The hand holding only cover 12 is then used to push cover 12 longitudinally along core 26 toward the hand tightly holding core 26 and cover 12, thus compressing cover 12 between the two hands. The hand which was previously holding only cover 12 is then used to tightly grasp both cover 12 and core 26 and the other hand releases core 26 and pulls cover 12 to stretch it out. As cover 12 stretches, window 24 moves over a section of core 26 which can be inspected. This action is repeated until the entire wire rope core has been inspected. One method of verifying that the entire loop has been inspected is to depend upon a small length of tape wrapped around the core which is used during the manufacture of the wire rope into a loop. Once the inspector has passed the tape and then come back to it, it is quite clear that the entire loop has been inspected.

FIG. 2 also shows window cover 14 in a different view from that shown in FIG. 1 which showed window cover 14 closed. In FIG. 2 window cover 14 is open for viewing core

26, and the Velcro tape pieces can be seen exposed. Flap 18, which is shown in FIG. 1 as having Velcro tape 20 on its outside surface has another piece of identical Velcro tape 32 on its inside surface. Velcro tape 32 therefore attaches to Velcro tape 34 on flap 16 when flap 16 is folded over to cover inspection window 24. After tape 32 is attached to tape 34 tabs 22 can be folded over as discussed in regard to FIG. 1.

An interesting side benefit derived from window cover 14 is that, since it is made from plastic sheet and is permanently sewn onto fabric cover 12 by stitching 30, it can be used as a product label or to provide safety information by merely printing upon flap 16 before..attaching it to fabric cover 12.

The present invention thereby provides a simple and economical solution to the problem of inspecting wire rope roundslings.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For example, multistrand core 26 can be conventionally constructed of wire rope or some other materials.

What is claimed as new and for which Letters Patent of the United States are desired to be secured is:

1. A roundsling hoisting loop comprising:

a length of multistrand core formed into a loop;

a flexible core cover covering the core, the core cover comprising a closed tube with its ends joined together to form a loop and with the tube fitting loosely on the core so that the core can slide completely around within the tube;

an inspection window formed in the tube by the removal of a portion of the tube so that a part of the core under the inspection window can be seen; and a window cover permanently attached to the tube in a manner so that the window cover can cover the inspection window.

2. The loop of claim 1 wherein the multistrand core is wire rope.

3. The loop of claim 1 further including a window cover which wraps around the tube and covers the inspection window.

4. The loop of claim 1 wherein the the window cover has two flaps which are attached to each other when the window cover is closed.

5. The loop of claim 1 wherein the tube is constructed of fabric.

6. The loop of claim 1 wherein the inspection window is formed by the removal of a part of the circumference of the tube at the location where the ends of the tube are joined together.

* * * * *